United States Patent [19]

Padrun

[11] Patent Number: 4,617,775

[45] Date of Patent: Oct. 21, 1986

[54] EXTENSIBLE REINFORCING BAR ASSEMBLY AND CLIP

[76] Inventor: John Padrun, 22800 Hutchinson Rd., Los Gatos, Calif. 95030

[21] Appl. No.: 647,045

[22] Filed: Sep. 4, 1984

[51] Int. Cl.[4] ..... E04C 5/20

[52] U.S. Cl. ..... 52/684; 24/545; 52/687; 403/393; 403/397

[58] Field of Search ..... 52/677–689; 403/389, 391, 392, 393, 395–399; 24/339, 545

[56] References Cited

U.S. PATENT DOCUMENTS

| | | | |
|---|---|---|---|
| 871,210 | 11/1907 | Cummings | 52/686 |
| 1,063,663 | 6/1913 | Davis | 52/686 |
| 1,068,003 | 7/1913 | Neevel | 52/686 |
| 1,686,678 | 10/1928 | Burke | 24/339 X |
| 1,816,301 | 7/1931 | Sundell | 403/397 |
| 2,128,062 | 8/1938 | Ward | 52/677 |
| 2,931,086 | 4/1960 | Rose | 24/545 |
| 3,421,187 | 1/1969 | Ryder | 403/391 |
| 3,983,602 | 10/1976 | Barry | 24/339 X |
| 4,063,397 | 12/1977 | Follows | 52/684 |
| 4,110,951 | 9/1978 | Padrun | 52/686 |

FOREIGN PATENT DOCUMENTS

| | | | |
|---|---|---|---|
| 876667 | 9/1961 | United Kingdom | 52/677 |
| 1142886 | 2/1969 | United Kingdom | 52/685 |

*Primary Examiner*—Alfred C. Perham

*Attorney, Agent, or Firm*—Flehr, Hohbach, Test, Albritton & Herbert

[57] ABSTRACT

An extensible reinforcing bar assembly for readily permitting a plurality of bars to be extended with respect to each other and establish a desired combined length. The assembly includes a plurality of improved plastic clips for attaching the two bars while permitting them to be movable with respect to each other under applied longitudinal force.

2 Claims, 6 Drawing Figures

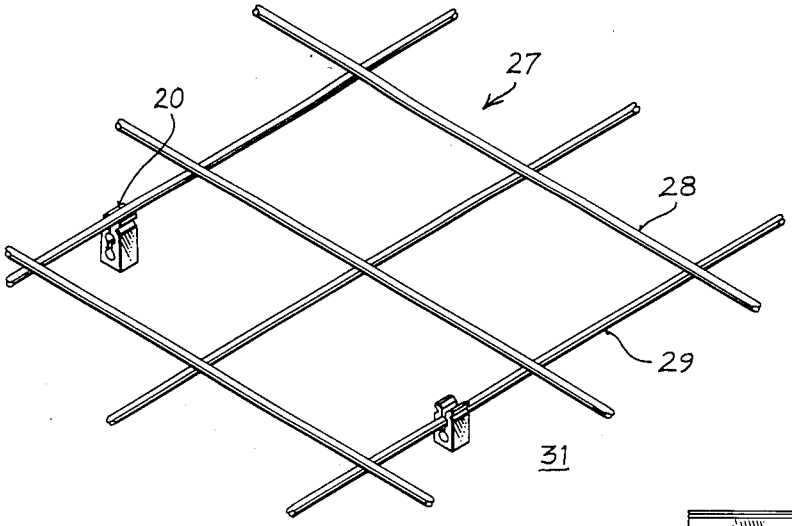
FIG_5
FIG_6
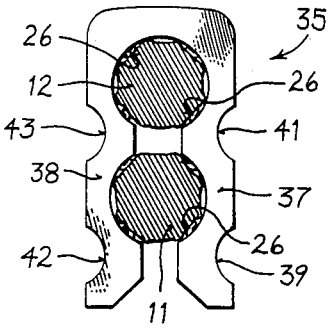
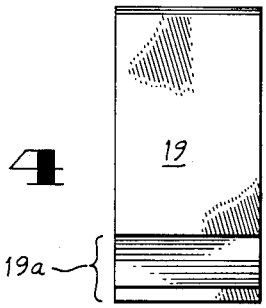
FIG_4
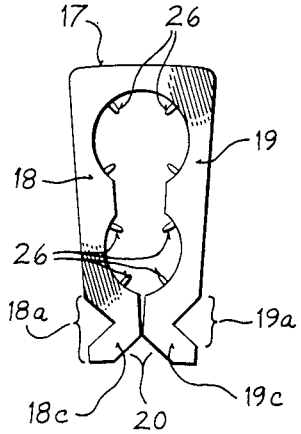
FIG_3
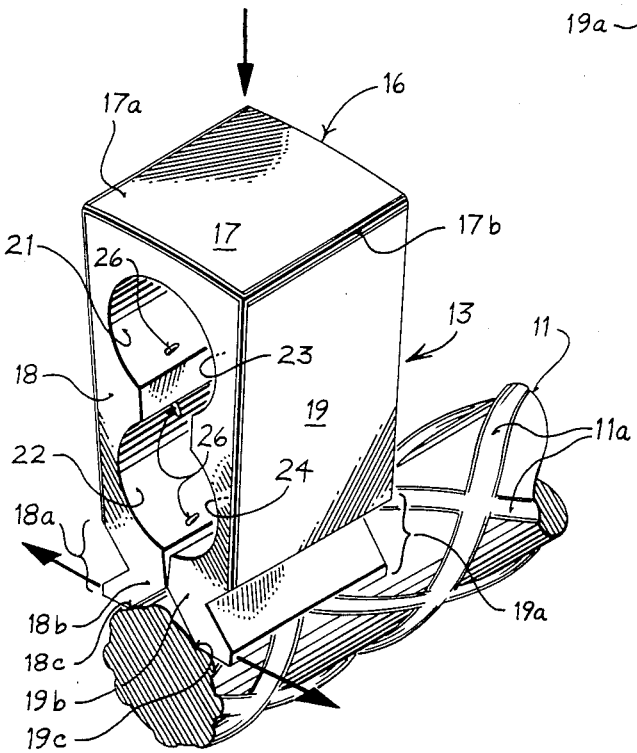
FIG_2
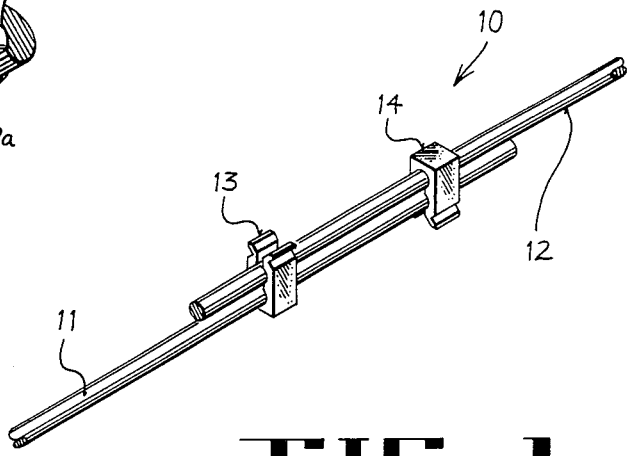
FIG_1

EXTENSIBLE REINFORCING BAR ASSEMBLY AND CLIP

This invention pertains to an extensible reinforcing bar assembly for use in reinforcing concrete and more particularly to such an assembly characterized by a plurality of clips retaining the bars in parallel relation with one end of one bar lying alongside a short length of the other end of the other bar so as to extend the combined length of both bars as desired.

The invention further pertains to a connecting clip for joining concrete reinforcing bars in a manner permitting one bar to be extended from the other.

It is known that in providing reinforced concrete, elongate bars of steel may be arranged in a matrix typically by tying the bars together using short lengths of wire. One significant improvement upon the foregoing technique is disclosed in U.S. Pat. No. 4,110,951 showing means adapted to be snapped onto each intersection of two reinforcing bars of a matrix.

The formation of such a matrix of reinforcing bars sometimes requires the wiring together of two parallel bars to achieve a desired combined length. This procedure, of course, does not permit the bars to be adjusted with respect to each other without re-wiring them together at a new position. This routine adds to the additional time involved in providing an appropriate matrix, and accordingly there has been a need for an improved extensible reinforcing bar assembly wherein the bars can be easily snapped together to be extensible to various combined lengths while remaining continuously gripped or clamped together.

In general, there has been provided an extensible reinforcing bar assembly for use in reinforcing concrete using first and second reinforcing bars having portions laid adjacent and parallel to each other. Each of a plurality of clips continuously grips both bars while retaining the bars in parallel relation in a manner permitting the combined length of both bars to be adjusted. The clips include a "U" shaped plastic unit formed to include a force receiving web which carries elongate confronting spaced apart impervious side panels therefrom. The panels include first and second pairs of relieved portions disposed in confronting relation to form first and second seats for holding the bars tightly therein. The side panels include limited resilience permitting the bars to be longitudinally adjusted to a desired combined length of the overall assembly.

In general, it is an object of the present invention to provide an improved reinforcing bar assembly and clip.

The foregoing and other objects of the invention will become more readily evident from the following detailed description of preferred embodiments when considered in conjunction with the drawings.

FIG. 1 shows a diagrammatic perspective view of an extensible reinforcing bar assembly according to the invention;

FIG. 2 shows an enlarged detailed view of a clip and bar in the process of installation;

FIGS. 3 and 4 respectively show end and side elevation views of the clip shown in FIGS. 1 and 2;

FIG. 5 shows an application of the clip to be used as a standoff or spacer for supporting a matrix of reinforcing bars.

FIG. 6 shows a diagrammatic elevation view of a clip according to the invention containing two reinforcing bars therein shown in transverse section.

DESCRIPTION OF PREFERRED EMBODIMENTS

An extensible reinforcing bar assembly 10 for reinforcing concrete includes a plurality of reinforcing bars 11, 12 held together in substantially parallel overlapping relation by means of a plurality of clips 13, 14. Clips 13, 14 are identical in construction and preferably applied from opposite sides of bars 11, 12 in order to maximize the strength with which bars 11, 12 will be gripped.

As described further below, clips 13, 14, securely clamp onto bars 11, 12, but permit the bars to be moved axially under applied force in order to adjust the combined length of assembly 10.

Clip 13 (and 14 as well) includes a single integral body 16 of semi-rigid plastic material. Body 16 preferably is molded and formed to include a force receiving or pressure transmitting web portion 17. A pair of confronting substantially coextensive side panels 18, 19 of limited resilience extend in a common direction from a pair of opposite side edges **17*a*, 17*b* of the web or base portion 17**.

The distal end of each side panel 18, 19 includes a "V" shaped end edge margin **18*a*. The apexes 18*b*, 19*b* of the "V" shaped edge margins 18*a*, 19*a* lie in mutual contact with each other. The limited resilience of panels 18, 19** serves to urge the distal ends thereof tightly together.

Each of the confronting surfaces of panels 18, 19 includes a plurality of arcuately relieved portions 21, 22, and 23, 24. Relieved portions 21, 22 of one panel 18 face the relieved portions 23, 24 respectively of the other panel 19 so as to define a plurality of seats between panels 18, 19 for resiliently receiving and tightly gripping each of two reinforcing bars in mutually parallel relation therebetween.

As shown in FIG. 2, urging clip 13 downwardly relative to a reinforcing bar 11, (as shown by the vertical arrows) serves to spread panels 18, 19 apart to permit bar 11 to enter into one or the other of the two seats shown. Accordingly, the remote halves **18*c*, 19*c* of each of the "V" shaped edge margins 18*a*, 19*a* mutually form a trough or groove 20 therebetween for guiding reinforcing bar 11 into clip 13**.

Clip 13 further includes a plurality of discrete, radially inwardly directed nibs 26 carried to protrude from the confronting surfaces of the arcuate portions 21, 23 and 22, 24. Nibs 26 serve to enhance gripping of a bar disposed beteen these pairs of arcuate surfaces. Preferably pairs of nibs 26 are disposed to lie on diameters across their associated opening or seat when a rod 11, 12 has been lodged in the opening.

Heretofore, when necessary to employ a longer reinforcing bar than might be immediately available, one practice has been to tie a pair of reinforcing bars tightly together with one extending beyond the end of the other. If the combined length of the two bars is satisfactory, and if the wire tying is sufficiently tight, the "elongated" combined reinforcing bars can be used to lie parallel within the plane of a slab of concrete.

However, in the event that the two bars need to be extended or contracted, it becomes necessary to untie, reposition and re-tie the two bars. In the event that the two bars have been tied sufficiently loosely together that they can be slidably moved with respect to one another, there exists a substantial opportunity for the two bars to form an angle and in this manner cause an end to protrude through the plane of the slab of concrete being poured.

As disclosed herein, clips 13, 14 serve to hold the two bars sufficiently tightly together to prevent one from being disposed at an angle (other than substantially (180°) to the other while at the same time permitting the two bars to be longitudinally adjusted in their overall combined length by applying appropriate force lengthwise of the bars 11, 12.

Accordingly, after a reinforcing bar has been inserted into the upper seat formed by relieved portions 21, 23 and another bar inserted into the seat formed between relieved portions 22, 24, the reinforcing bars will lie in a common plane disposed between the planes of panels 18, 19. It is to be noted in FIG. 3 that panels 18, 19, while nearly perpendicular to the plane of web or base portion 17 are actually disposed at a slight angle thereto so as to apply a relatively strong resilient force between the contacting portions **18*b*, 19*b*. This slight inward bending of panels 18, 19** is achieved by using a mold in which mold portions forming the sides of the clip are parallel. However, as is known, the longer the product is left to cool in the mold, the more accurate the "set" will be of the molded unit. In the present instance Applicant prefers to remove the article from the mold relatively soon after it has been molded and to permit the unit to cool outside the mold. This causes the sides of the clip to draw toward each other and thereby provide a substantial resilient force therebetween.

In addition to the above, clips 13 can be utilized as a stand-off or spacer element in spacing a matrix 27 of reinforcing bars 28, 29 as now to be described.

The intersections of reinforcing bars 28, 29 may be coupled together using a device employing the teaching of the above-identified U.S. patent. When clips 13 are to be used as a spacer the clip is simply inverted and the base or web portion 17 disposed upon a support surface 31. In many instances this support surface 31 will simply be the ground.

Thus, in so using clip 13 as a stand-off or spacer for supporting bars 28, 29 from a support surface 31, the barsn can simply rest in the clips trough 20 in order to obtain maximum spacing.

In order to more securely hold the stand-off support elements beneath the matrix to prevent them from becoming dislodged while concrete is being poured, it may be preferable to dispose the bars in the "upper" seat of clip 13 as inverted and defined between relieved arcuate surfaces 22, 24.

According to another embodiment, clip 35 (FIG. 6) has been formed in a manner to include confronting side panels 37, 38 in a manner to include vertically spaced, rounded grooves 39, 41 and 42, 43 whereby when concrete is poured it will more readily flow into and fill these grooves to tightly lock the clip in place as the concrete hardens.

In addition, by removing a limited amount of the mass of side panels 37, 38, clip 35 can be somewhat more flexible to permit the sides to be more easily spread apart if desired.

From the foregoing it will be readily evident that there has been provided an improved extensible reinforcing bar assembly 10 and relatively simple clips 13 adapted to hold a pair of reinforcing bars 11, 12 in parallel, extensible relation. Preferably the clips are applied from opposite sides of the two bars 11, 12 in order to more securely join the two bars together. In addition, clips of the kind described can be used as a stand-off or spacer for supporting a matrix of reinforcing bars from a support surface.

Finally, the radially inwardly protruding nibs 26 carried on the arcuate surfaces 21 through 24 serve to continuously grip and hold the bars sufficiently tightly to permit the assembly 10 to lie within the plane of a slab of concrete being poured. In addition, nibs 26 permit longitudinal adjustment of the combined length when appropriate force is applied. Thus, nibs 26 "interlock" somewhat with ribs **11*a* of a type typically found on bars 11, 12. Thus, as a bar is urged through clip 13, or 14, nibs 26 must pass across ribs 11*a* so as to inhibit relative movement through clip 13 or 14**.

I claim:

1. An extensible reinforcing bar assembly for use in reinforcing concrete comprising first and second cylindrical reinforcing bars, a plurality of clips retaining said bars in parallel relation, one end portion of said first bar lying alongside a length of the other said bar intermediate the ends thereof so as to combine the overall length of both bars in extensible relation therebetween, said clips including a U-shaped plastic unit formed to be forced onto said first and second said bars, said unit including a force-receiving web at one end, said web carrying elongate confronting spaced apart side panels, said panels having first and second pairs of relieved surface portions disposed in confronting relation to form first and second seats for holding said bars tightly and independently therebetween, the confronting surfaces of each of said seats including portions disposed to underlie an associated one of said bars seated therein, said confronting surfaces being disposed to substantially meet at the free end of said panels when no bar is seated in said clip, said side panels having limited resilience serving to tightly engage the sides of said bars therebetween while permitting said bars to be longitudinally adjusted to provide the desired combined length of said assembly, the exterior region laterally to the sides of said clips being free of protuberances therefrom.

2. An extensible reinforcing bar assembly comprising a pair of substantially cylindrical reinforcing bars of a type used in reinforcing concrete, clips for use in independently carrying said bars in parallel relation, each said clip comprising a unitary body of plastic material formed to include a pressure-transmitting web portion, opposed impervious panels carried from said web portion in mutually spaced relation alongside said bars and in a manner strongly urging said panels together to meet at the distal ends thereof in the absence of a bar therebetween, each of the confronting surfaces of said panels including a pair of spaced, arcuately relieved portions, pairs of said portions being taken from both panels serving to form a pair of seats to support a pair of said bars in parallel relation independently of each other, portions of said seats underlying an associated bar disposed between the relieved surface portions of said seats.

* * * * *